US007874091B2

(12) United States Patent
Fu et al.

(10) Patent No.: US 7,874,091 B2
(45) Date of Patent: Jan. 25, 2011

(54) UNDERWATER GUN COMPRISING A PLATE-TYPE BARREL SEAL

(75) Inventors: Jyun-Horng Fu, Centreville, VA (US); Robert James Howard, Clifton, VA (US); John W. Rapp, Manassas, VA (US); Antonio Paulic, Arlington, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 298 days.

(21) Appl. No.: 12/165,071

(22) Filed: Jun. 30, 2008

(65) Prior Publication Data

US 2010/0281729 A1 Nov. 11, 2010

(51) Int. Cl.
*F41C 9/06* (2006.01)

(52) U.S. Cl. ..... 42/1.14; 89/1.809; 89/1.81; 89/5; 89/31; 114/316

(58) Field of Classification Search ..... 42/1.14; 89/1.809, 1.81, 5, 31; 114/316, 18, 19
See application file for complete search history.

(56) References Cited

U.S. PATENT DOCUMENTS

| | | | | |
|---|---|---|---|---|
| 1,186,023 | A * | 6/1916 | Moore | 89/31 |
| 5,639,982 | A | 6/1997 | Cipolla | |
| 5,648,631 | A | 7/1997 | Kirschner et al. | |
| 5,687,501 | A | 11/1997 | Stace et al. | |
| 5,746,018 | A | 5/1998 | Kirschner et al. | |
| 5,966,858 | A | 10/1999 | Curtis et al. | |
| 6,701,819 | B1 | 3/2004 | Williams et al. | |
| 7,237,353 | B1 | 7/2007 | Beauchamp et al. | |

* cited by examiner

*Primary Examiner*—J. Woodrow Eldred
(74) *Attorney, Agent, or Firm*—DeMont & Breyer, LLC

(57) ABSTRACT

An apparatus for sealing the barrel of an underwater gun between firings is disclosed. The apparatus comprises a magnetically-attractable water-impermeable disk. Via operation of a drive system, the disk is movable between a sealing position, wherein it prevents water from entering the barrel by moving into alignment with the first bore, and a firing position, wherein the first water-impermeable disk moves out of alignment with the first bore.

15 Claims, 4 Drawing Sheets

UNDERWATER GUN COMPRISING A PLATE-TYPE BARREL SEAL

CROSS REFERENCE TO RELATED APPLICATIONS

This case is related to the following U.S. patent application Ser. Nos. 12/165,060 (Underwater Gun Comprising a Valve-Type Barrel-Seal), 12/165,066 (Underwater Gun Comprising a Barrel Adapter including a Barrel Seal), 12/165,079 (Underwater Gun Comprising a Passive Fluidic Barrel Seal), and 12/165,090 (Underwater Gun Comprising a Turbine-Based Barrel Seal), all of which were filed on even date herewith and all of which are incorporated by reference herein.

FIELD OF THE INVENTION

The present invention relates to underwater guns.

BACKGROUND OF THE INVENTION

Underwater guns are useful as anti-mine and anti-torpedo devices. Recently, autonomous underwater vehicles (AUVs) have been fitted with underwater guns for torpedo defense and underwater "hunter-killer" CONOPs.

A gun, especially one with a high muzzle velocity, cannot be fired when water is in its barrel. If a firing where to incur in a water-filled barrel, a very high breach pressure would result as the ignited propellant charge forces (or tries to force) the water out of the barrel. The likely result would be material failure of the barrel.

The prior art is replete with approaches for waterproofing the barrel of an underwater gun, or for clearing water from its barrel before firing. U.S. Pat. No. 5,639,982 discloses a means for firing a fully automatic gun underwater using a blank barrel-clearance round. Blank barrel-clearance rounds are alternated with live rounds of ammunition. To begin the process, a blank barrel-clearance round is first detonated. This creates gas and steam within the chamber that forms a bubble at the muzzle end of the barrel, thereby displacing water from the chamber. A live round is then immediately fired. The process is repeated, whereby the subsequent detonation of a blank barrel-clearance round displaces any water that has re-entered the barrel subsequent to the firing of the live round.

U.S. Pat. No. 5,648,631 discloses a spooled tape seal for sealing the barrel of an underwater gun. The system includes a tap that covers the opening of the gun barrel and sprockets for advancing the tape across the opening. Hydrostatic pressure keeps the tape pressed to the end of the barrel to create an effective seal. When a bullet is fired, it perforates the tape. During this brief period of egress, the exhaust gases from combustion of the propellant charge keep water from entering the barrel. Almost immediately, a non-perforated portion of the tape is advanced by the sprockets to cover the barrel opening. External hydrostatic pressure re-seats the tape, thereby preventing water from entering the barrel.

U.S. Pat. No. 5,687,501 discloses a sealing plate for providing a watertight seal for a multi- or single-barreled underwater gun. The sealing plate provides one or more firing apertures in an otherwise solid surface. Between firings, the gun muzzle is sealed by a solid surface of the sealing plate. To fire a bullet, the sealing plate or muzzle rotates to align the gun muzzle with one of the firing apertures. This permits unimpeded egress. After the bullet fires, the plate or muzzle again rotates so that a solid portion of the sealing plate covers the muzzle.

These are but a few of the many patents pertaining to various aspects of underwater gun design in general, and to the water-in-the-barrel problem, in particular. Notwithstanding the many approaches to the problem, no truly satisfactory approach has been developed for keeping water out of the barrel of an underwater gun between and during operation.

SUMMARY OF THE INVENTION

The present invention provides an underwater gun having a plate-type barrel seal for preventing water from entering the barrel between the firing of rounds.

In the illustrative embodiment, the barrel seal comprises one or more disks that, by virtue of an actuation system, are moved between a "sealing" state and a "firing" state. In the sealing state, the disk is axially aligned with and abuts the muzzle end of the gun's barrel, thereby substantially preventing water from entering the barrel. In the firing state, the disk is moved out of axial alignment with the barrel such that a round is free to exit the barrel without interference from the disk.

In some embodiments, the actuation system comprises a drive shaft, drive, controlled power source, and a controller. When triggered by the gun's fire-control system, the controller directs the controlled power source to power the drive, which turns the drive shaft. The drive shaft rotates a disk into the sealing state or the firing state, as appropriate.

In some other embodiments, the actuation system comprises an electromagnet, controlled current source, and controller. A plurality of magnetic (or magnetically attractable) disks are stored in a supply region within a housing that surrounds the barrel of the gun. When triggered by the gun's fire-control system, the controller directs the controlled current source to supply current to the electromagnet. The energized electromagnet generates a magnetic field, which draws a disk from a supply region in the housing. Based on the orientation of the magnetic field, the disk is drawn into axial alignment with the barrel. The disk is magnetically attracted to the muzzle end of the barrel and thereby seals the barrel. When the magnetic field is withdrawn by stopping the current flow, the disk falls away from the barrel and into a return region of the housing.

DETAILED DESCRIPTION

The terms appearing below are defined for use in this specification, including the appended claims, as follows:

- Axially-oriented (or axial orientation) refers to an orientation that aligns with the longitudinal axis of an element. This orientation is orthogonal to a radial orientation.
- Barrel is a narrow, hollow cylindrical portion of a firearm through which a projectile travels.
- Bore is the hollow portion of the barrel through which a projectile travels during its acceleration phase.
- Breech is an opening in the rear of a barrel of a gun where projectiles can be loaded.
- Chamber is the portion of a barrel where a projectile is placed just prior to being fired. This is a high pressure containment area which is very precisely aligned with the bore of the barrel.
- Fluidically coupled or fluidic communication means that liquid, gas, or vapor from a first region can flow to or otherwise affect a second region. For example, if two regions are fluidically coupled (or in fluidic communication), a pressure change in one of those regions might result in a pressure change in the other of the regions.
- Muzzle is the opening at an end of the barrel where a projectile that has been fired exits the barrel.
- Operatively coupled means that the operation of one device affects another device, wherein the devices need not be physical attached to one another. For example, a laser and a mirror are operatively coupled if a laser directs a beam of light to the mirror. An actuator and a valve are operatively coupled if the actuator actuates the valve, regardless of whether there other intermediary mechanisms between the actuator and the valve. Operatively-coupled devices can be coupled through any medium (e.g., semiconductor, air, vacuum, water, copper, optical fiber, etc.) and involve any type of force. Consequently, operatively-coupled objects can be electrically-coupled, hydraulically-coupled, magnetically-coupled, mechanically-coupled, optically-coupled, pneumatically-coupled, thermally-coupled, etc.
- Radially-oriented (or radial orientation) refers to an orientation that is coincident with the radial direction of an element. See "axially-oriented."

The present invention pertains to guns that are intended for (1) use in an underwater environment and (2) firing rounds that include a chemical propellant. The underwater guns described herein will typically, although not necessarily, be fitted to AUVs. For clarity, gun 100 is typically depicted in the Figures as having a single round in the chamber or bore. It is to be understood, however, that gun 100 is typically a multi-shot weapon.

Figure 1:
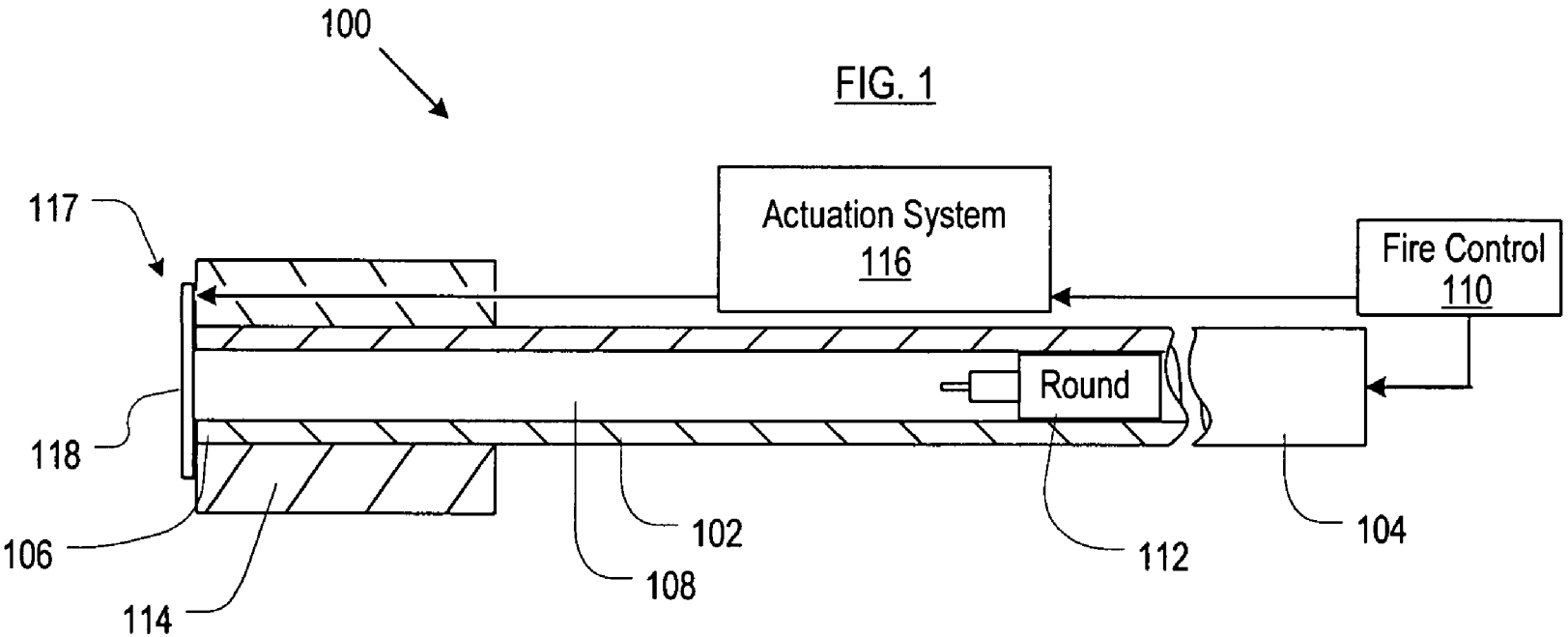
FIG. 1 depicts an underwater gun comprising a plate-type barrel seal in accordance with the illustrative embodiment of the present invention.

FIG. 1 depicts underwater gun 100, which includes a plate-type barrel seal in accordance with the present invention.

Gun 100 includes barrel 102, chamber 104, bore 108, fire-control system 110, and elements of the plate-type barrel seal. The plate-type barrel seal comprises housing 114, actuation system 116, and plate arrangement 117. A live round 112 is depicted in bore 108.

Barrel 102, chamber 104, and bore 108 are conventional features of most guns. Fire-control system 110 is basically a computer and ancillary elements that enable gun 100 to hit a target. The relative sophistication of any particular embodiment of fire-control system 110 is primarily a function of the intended application for gun 100. That is, a relatively more sophisticated fire-control system is required for a relatively more autonomous application (e.g., for use in conjunction with an AUV, etc.).

In a typical embodiment, fire-control system 110 interfaces with one or more sensors (e.g., sonar, radar, infra-red search and track, laser range-finders, water current, thermometers, etc.). The sensor input is used to develop a firing solution for a target. To the extent that gun 100 is located on an AUV, etc., fire-control system 110 advantageously takes into account movements of the AUV itself. And, when associated with an AUV, fire-control system 110 is operatively coupled to aiming and firing mechanisms.

The structural details of the fire-control system are not particularly germane to an understanding of the invention and, furthermore, are well understood by those skilled in the art. As a consequence, fire-control system 110 will not be described in further detail.

As previously noted, the plate-type barrel seal comprises housing 114, actuation system 116, and plate arrangement 117. The plate arrangement includes at least one water-impermeable disk 118 that is capable of preventing water from entering barrel 102.

Disk 118 is movable, via the action of actuation system 116, between:

(a) a sealing position, as depicted in FIG. 1, wherein at least one disk 118 of plate arrangement 117 is axially aligned with barrel 102 and bore 108; and (b) a firing position, wherein a disk is not axially aligned with bore 108 and, furthermore, no portion of a disk occludes the bore.

In some embodiments, the disk and barrel 102 are magnetized (or otherwise magnetic), such that when the disk 118 aligns with bore 108 to seal barrel 102, the disk is pulled against the muzzle of barrel 102 to effect a seal.

FIG. 1 depicts a "generic" manifestation of a plate-type barrel seal. This specification now proceeds with a description of several specific embodiments of the plate-type barrel seal.

Figure 2:
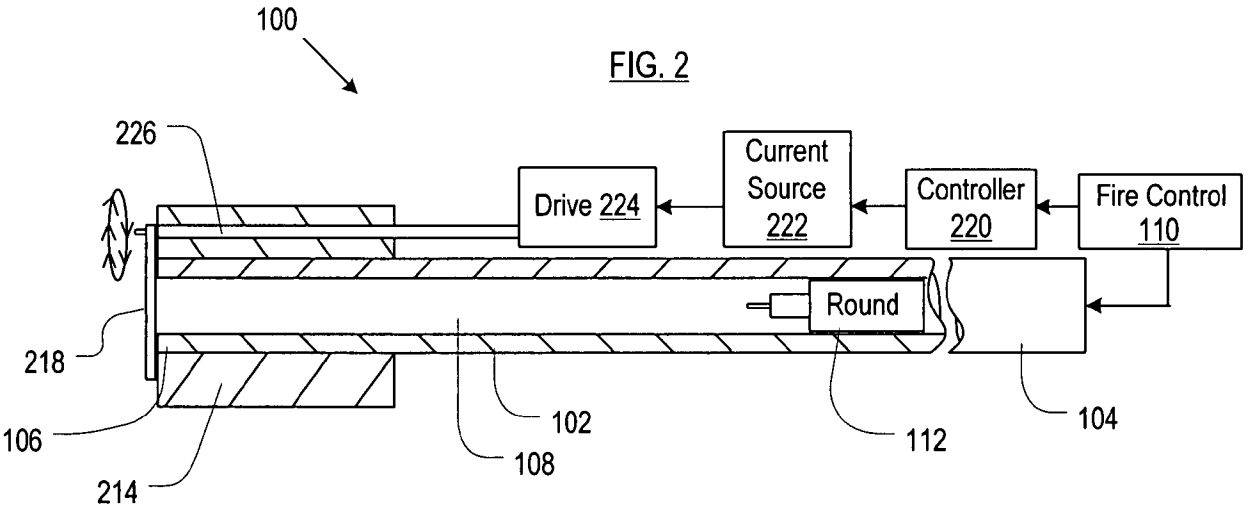
FIG. 2 depicts a first embodiment of a plate-type barrel seal for use in conjunction with the underwater gun of FIG. 1.

FIG. 2 depicts a first embodiment of a plate-type barrel seal for use in conjunction with underwater gun 100. FIG. 2 depicts barrel 102 of gun 100 in a sealed state.

In the embodiment that is depicted in FIG. 2, actuation system 116 comprises controller 220, current source 222, drive 224, and drive shaft 226, interrelated as shown.

Controller 220 includes a microprocessor that is capable of receiving a signal from fire-control system 110 and taking action responsive thereto. In some embodiments, that action is to generate a signal that causes current source 222 to deliver current or stop delivering current. Drive 224, when energized with current from current source 222, is operable to turn driveshaft 226. In some embodiments, drive 224 is an electric motor.

Plate arrangement 117 is operatively coupled to drive shaft 226. The movement of the drive shaft is controlled, ultimately, by fire-control system 110. More particularly, fire-control system 110 directs controller 220 to cause current source 222 to supply current to drive 224. Once activated, drive 224 causes drive shaft 226 to turn, thereby causing plate arrangement 117 to rotate a disk into or out of registration with barrel 102.

Figure 3C:
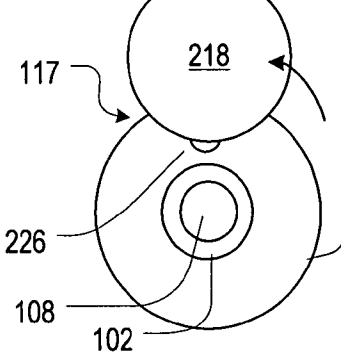
FIGS. 3A-3C depict, sequentially, the movement of a plate arrangement from a sealing state to a firing state. These Figures depict a first embodiment of a plate arrangement for use in conjunction with the first embodiment of the plate-type barrel seal of FIG. 2, wherein the plate arrangement comprises a single disk.
Figure 3B:
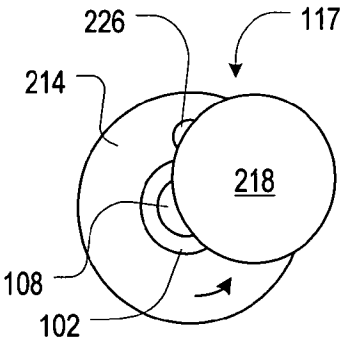
Figure 3A:
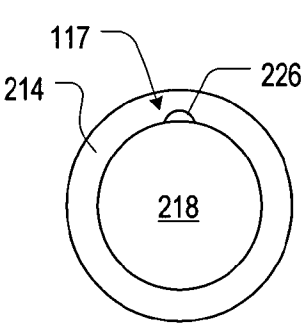

FIGS. 3A through 3C depict, via a sequence of front views, a disk of plate arrangement 117 being moved from the sealing position to the firing position. A portion of drive shaft 226 and housing 214 are visible in each of these Figures. These Figures depict a first embodiment of plate arrangement 117 for use in conjunction with the first embodiment of a plate-type barrel seal. In particular, plate arrangement comprises a single disk 218 that is operatively coupled to drive shaft 226. Although disk 218 is depicted as having a circular shape, it will be appreciated that in other embodiments, other shapes can suitably be used (e.g., square, rectangular, etc.).

FIG. 3A depicts disk 218 in the sealing position, occluding the mouth of barrel 102. FIG. 3B depicts disk 218 as it is being rotated out of the sealing position, revealing barrel 102 and bore 108. FIG. 3C depicts disk 218 after it has rotated fully out of the sealing position and into the firing position. In FIG. 3C, no portion of disk 218 obscures barrel 102 or bore 108.

Figure 4B:
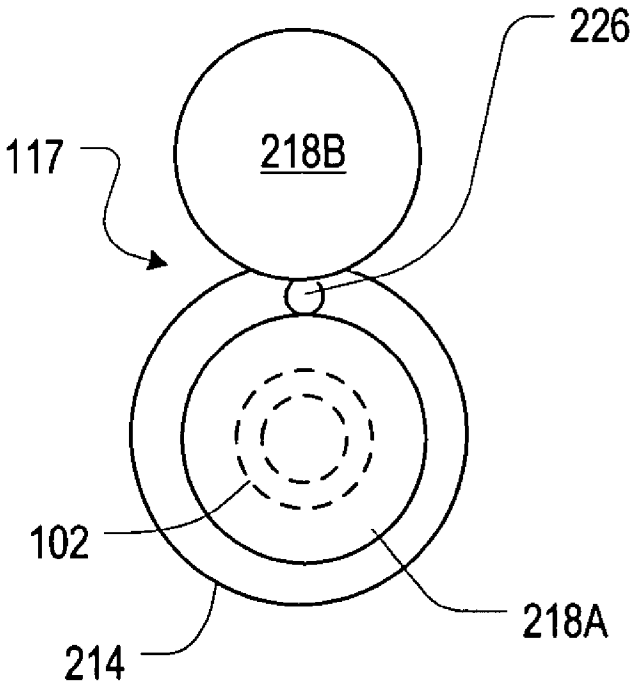
FIGS. 4A-4B depict, sequentially, the movement of a plate arrangement from a firing state to a sealing state. These Figures depict a second embodiment of a plate arrangement for use in conjunction with the first embodiment of the plate-type barrel seal of FIG. 2, wherein the plate arrangement comprises two disks.
Figure 4A:
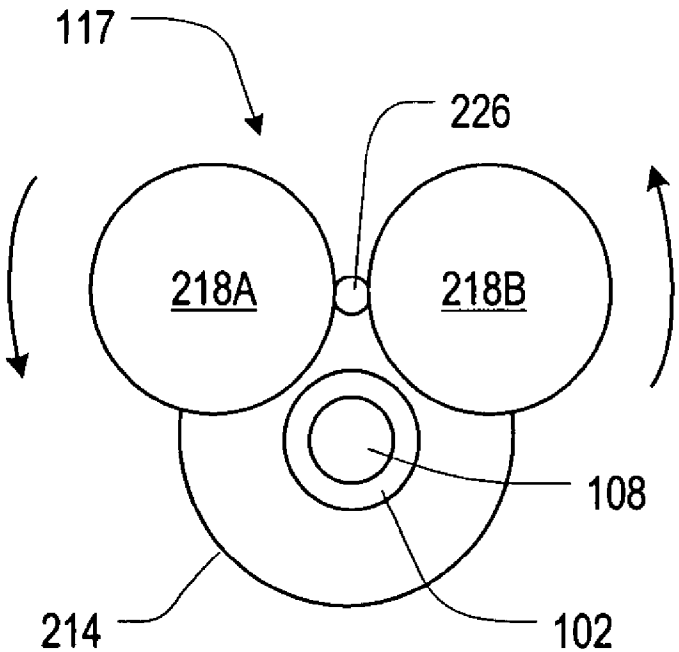

FIGS. 4A and 4B depict a second embodiment of plate arrangement 117 for use in conjunction with the plate-type barrel seal. In particular, the plate arrangement comprises two disks 218A and 218B that are operatively coupled to drive shaft 226. The barrel seal moves from a firing (or sealing) state to the opposite state by rotating drive shaft 226 by ninety degrees. For example, FIG. 4A depicts plate arrangement 117 in a firing state, wherein neither disk 218A nor disk 218B occludes barrel 102. As drive shaft 226 moves ninety degrees counter clockwise, disk 218A is moved into axial alignment with barrel 102, thereby placing the barrel seal in the sealing state. In some embodiments, a stepper motor is used as drive 224. Alternatively, any of a variety of mechanical linkage arrangements suitable for creating a stepped movement, as known to those skilled in the art, can be used in conjunction with a motor.

It will be appreciated that fire-control system 110 must synchronize the operation of the barrel seal with the firing of a round (after a period of quiescence) or with the cessation of firing (after a period of continuous firing).

There are a number of time delays that must be considered in the context of synchronizing the operation of the barrel seal with the onset or cessation of firing. In particular, there is a finite amount of time, typically a millisecond or so, that it takes for round 112 to transit barrel 102 to muzzle end 106. This time is, of course, a function of the amount of charge used, the length of the barrel, etc. Furthermore, there is a time delay between the moment that fire-control system 110 signals actuation system 116 to move plate arrangement 117 and the moment that the plate arrangement:

- begins to move;
- moves a sufficient amount to release pressure from bore 108; and
- moves a sufficient amount to enable round 112 to exit muzzle end 106 of barrel 102 without impeding the movement of the round.

As a consequence, after receiving a command to fire gun 100, fire-control system 110 will typically first actuate the barrel-seal system before firing round 112. The development of such a timing scheme is within the capabilities of those skilled in the art.

When round 112 is fired, combustion gases are generated (upon ignition of the round's chemical propellant). Pressure in bore 108 and chamber 104 rapidly rise as a consequence of the combustion process. To the extent that there is some amount of water in bore 108, the out rush of combustion gases through the muzzle of the barrel will expel such water.

If gun 100 continues to fire rounds, the substantially continuous generation of combustion gases will keep the barrel free of water. Upon an indication that firing is to cease, fire-control system 100 will advance plate arrangement to the sealing state, thereby sealing barrel 102.

Figure 5:
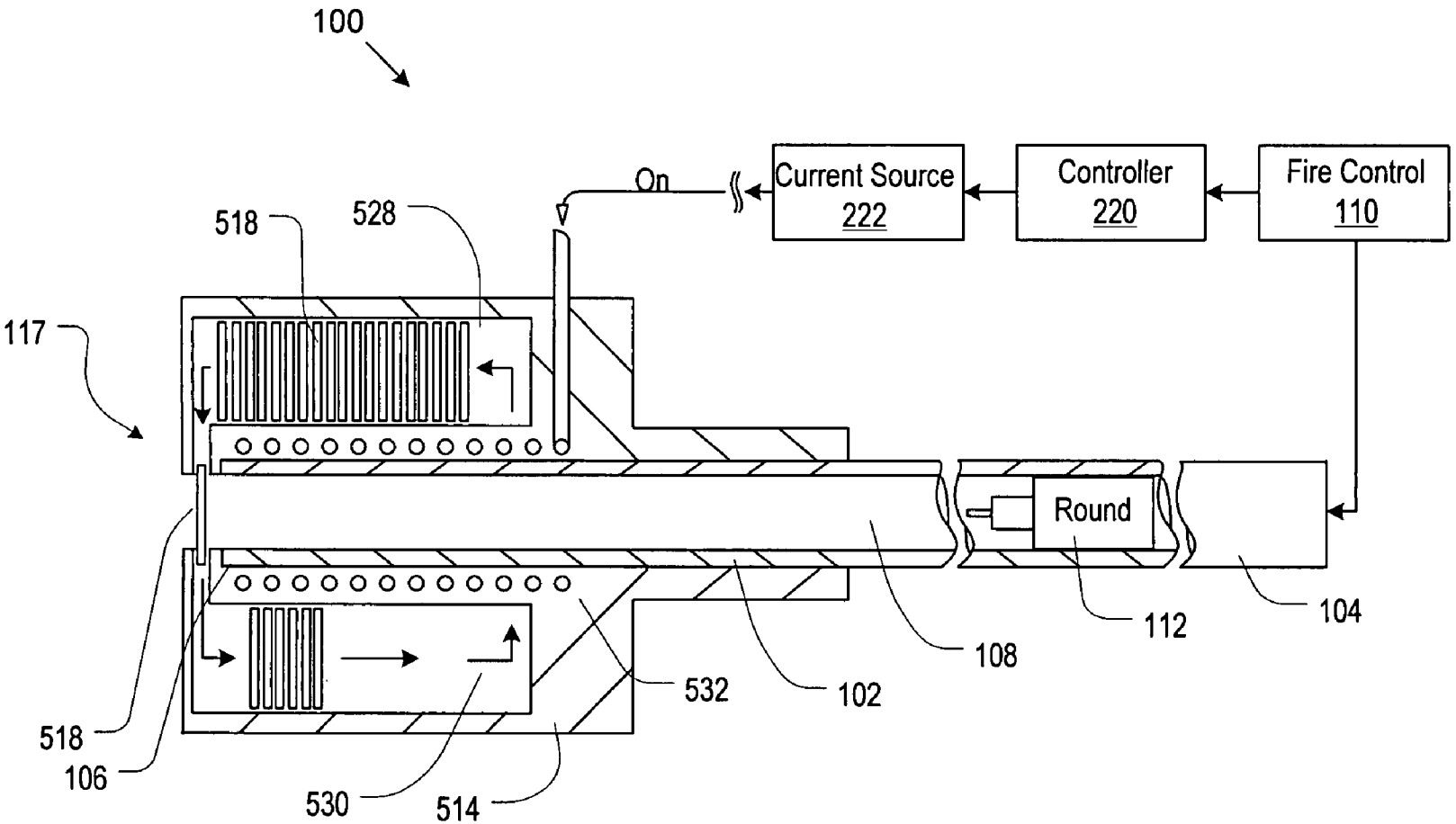
FIG. 5 depicts a second embodiment of a plate-type barrel seal for use in conjunction with the underwater gun of FIG. 1.

FIG. 5 depicts a second embodiment of a plate-type barrel seal for use in conjunction with underwater gun 100. FIG. 5 depicts barrel 102 of gun 100 in a sealed state.

Plate arrangement 117 comprises a plurality of disks 518, which are stored in supply region 528 of housing 514. The supply region is disposed vertically above barrel 102. In some embodiments, disks 518 are biased toward the muzzle end of the barrel by a spring, etc. (not depicted in FIG. 5).

In the embodiment that is depicted in FIG. 5, the actuation system comprises controller 220, current source 222, and coil 532, interrelated as shown. Controller 220 includes a microprocessor that is capable of receiving a signal from fire-control system 110 and taking action responsive thereto. In some embodiments, that action is to generate a signal that causes current source 222 to deliver current or stop delivering current.

Current from current source 222 is delivered to coil (electromagnetic) 532. The movement of current through coil 532 generates a magnetic field. The magnetic field that is generated by coil 532 draws one of the disks 518 into a sealing position at muzzle end 106 of barrel 102. Current flow is maintained through coil 532 for as long as barrel 102 is to be sealed.

When fire-control system 110 receives a signal to fire gun 100, it signals controller 220. The controller then takes appropriate action (e.g., sends a signal, etc.) to stop the flow of current from current source 222. In the absence of the magnetic field that is generated by the flowing current, disk 518 drops away from muzzle end 106 of barrel 102 into return or storage region 530 of housing 514. In some embodiments, housing 514 is configured so that disks 518 simply accumulate in return region 530. When the number of disks 518 in supply region 528 reaches some figure (e.g., 100, etc.), an indication directs an operator to empty return region 530 and re-supply supply region 528 with disks 518 at a convenient time. Since gun 100 will often be disposed on an AUV and operated substantially autonomously, the "indication" might appear, for example, on a panel in a control room on the mother ship, etc.

In some further embodiments, housing 518 is configured so that disks 518 can be automatically shuttled from return region 530 to supply region 528. Any mechanism suitable for such purpose (e.g., a conveyor system, etc.), as is known to those skilled in the art, may be used.

Similar to the first embodiment of the plate-type barrel seal, fire-control system 110 must synchronize the operation of the second embodiment of plate-type barrel seal with the firing of a round (after a period of quiescence) or with the cessation of firing (after a period of continuous firing).

For this case, the relevant time delays that must be considered in the context of synchronizing the operation of the barrel seal with the onset or cessation of firing include:

- The time it takes for round 112 to transit barrel 102 to muzzle end 106.
- The time delay between the moment that fire-control system 110 signals actuation system 116 to move plate arrangement 117 to the firing state and the moment when a disk has dropped away from barrel 102 so as to enable round 112 to exit muzzle end 106 of barrel 102 without impeding the movement of the round.
- The time delay between the moment that fire-control system 110 signals actuation system 116 to move plate arrangement 117 to the sealing state and the moment when a disk has moved into a sealing position.

As a consequence, after receiving a command to fire gun 100, fire control 110 will typically first actuate the barrel-seal system before firing round 112. The development of such a timing scheme is within the capabilities of those skilled in the art.

When round 112 is fired, combustion gases are generated (upon ignition of the round's chemical propellant). Pressure in bore 108 and chamber 104 rapidly rise as a consequence of the combustion process. To the extent that there is water in bore 108, the out rush of combustion gases through the muzzle of the barrel will expel such water.

To the extent that gun 100 continues to fire rounds, the substantially continuous generation of combustion gases will keep the barrel free of water. Upon an indication that firing is to cease, fire-control system 110 will advance plate arrangement to the sealing state, thereby sealing barrel 102.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An underwater gun, comprising:

a barrel, wherein the barrel has a muzzle-end and an axially-oriented first bore;

a water-impermeable disk that is capable of being attracted by a magnetic field;

a drive system that generates a magnetic field that move the disk into a sealing position wherein the disk aligns with the first bore, wherein the drive system comprises:

(a) a wire disposed proximal to the muzzle end of the barrel, wherein when the wire receives a current, it generates the magnetic field; and (b) a current source that is electrically coupled to the wire; and a controller, wherein the controller signals the drive system to either:

(i) stop or reduce the flow of current to the wire when the gun is to be fired; or (ii) apply current to the wire to generate the magnetic field to move the disk to the sealing position.

2. The underwater gun of claim 1 further comprising a barrel adapter, wherein:

(a) the barrel adapter has a muzzle end and first end;

(b) the barrel adapter is coupled, at the first end thereof, to the muzzle end of the barrel; and (c) the barrel adapter comprises an axially-oriented second bore that aligns with the first bore of the barrel.

3. The underwater gun of claim 2 wherein the wire is coiled around the barrel adapter and magnetizes the barrel adapter when the wire receives a current.

4. The underwater gun of claim 3 and further comprising a guide, wherein the guide is disposed in the barrel adapter and external to the barrel, wherein the guide receives the water-impermeable disk.

5. The underwater gun of claim 4 and further comprising a return mechanism for receiving the water-impermeable disk when current delivery ceases and returning it to the guide, wherein the return mechanism is disposed in the barrel adapter and external to the barrel.

6. An underwater gun, comprising:

a barrel, wherein the barrel has a muzzle-end and an axially-oriented first bore;

a shaft that is rotatable about a longitudinal axis thereof and that is external to the barrel;

a drive system, wherein the drive system drives the shaft to rotate;

a first water-impermeable disk that is coupled to the shaft and rotatable therewith, wherein the rotation causes the first disk to move substantially co-planar with the muzzle-end of the barrel thereby moving the disk between:

(a) a sealing position, wherein the first disk aligns with and seals against the muzzle-end of the barrel; and (b) a firing position, wherein the first disk does not align with or seal the muzzle-end of the barrel; and a controller, wherein the controller signals the drive system to partially rotate the shaft to advance the first disk to a firing position upon receiving a signal from a fire-control system.

7. The underwater gun of claim 6 and further wherein after signaling the drive system to advance the first disk to the firing position, the controller signals the drive system to rotate the shaft to advance the first disk to the sealing position after a time delay that permits passage of a live round through the muzzle-end of the barrel.

8. The underwater gun of claim 6 wherein the drive system comprises a motor.

9. An underwater gun, comprising:

a barrel, wherein the barrel has a muzzle-end and an axially-oriented first bore having a first diameter;

a barrel adapter, wherein:

(a) the barrel adapter has a muzzle end and first end;

(b) the barrel adapter is coupled, at the first end thereof, to the muzzle end of the barrel;

(c) the barrel adapter comprises an axially-oriented second bore that aligns with the first bore of the barrel;

a water-impermeable disk that is capable of being attracted by a magnetic field, wherein the disk is disposed proximal to the muzzle end of the barrel adapter and has a second diameter that is larger than the first diameter;

a wire, wherein the wire is coiled around the barrel adapter and magnetizes the barrel adapter when the wire receives a current;

a current source that is electrically coupled to the wire; and a controller for controlling delivery of current from the current source to the wire, wherein:

(a) the controller signals the current source to cease current delivery upon receiving a signal from a fire-control system; and (b) the controller signals the current source to deliver current to the wire after a time delay that enables transit of a live round through the muzzle-end of the barrel.

10. The underwater gun of claim 9 further comprising a guide, wherein the guide is disposed in the barrel adapter and external to the barrel, wherein the guide receives the water-impermeable disk.

11. The underwater gun of claim 10 further comprising a return mechanism for receiving the water-impermeable disk when current delivery ceases and returning it to the guide, wherein the return mechanism is disposed in the barrel adapter.

12. The underwater gun of claim 7 further comprising a second water-impermeable disk that is coupled to the shaft and rotatable therewith.

13. The underwater gun of claim 12 wherein the second disk is diametrically opposed to the first disk about the shaft.

14. The underwater gun of claim 13 wherein, when the shaft is rotated by ninety degrees, the gun changes state between a firing state and a non-firing state, wherein:

(a) in the firing state, neither one of the first disk nor second disk aligns with or seals the muzzle-end of the barrel; and (b) in the non-firing state, either one of the first disk or the second disk aligns with and seals the muzzle-end of the barrel.

15. The underwater gun of claim 12 wherein the drive system comprises a stepper motor.

* * * * *